US005580282A

United States Patent [19]

Paterek

[11] Patent Number: 5,580,282

[45] Date of Patent: Dec. 3, 1996

[54] SEALABLE SHAPED CONNECTOR BLOCK FOR A TERMINAL ASSEMBLY

[75] Inventor: F. Dieter Paterek, Hamilton County, Ohio

[73] Assignee: Emerson Electric Co., St. Louis, Mo.

[21] Appl. No.: 180,965

[22] Filed: Jan. 14, 1994

[51] Int. Cl.[6] ..... H01R 21/00

[52] U.S. Cl. ..... 439/685; 439/271

[58] Field of Search ..... 439/271, 281, 439/283, 685–687, 935, 426, 610; 326/429

[56] References Cited

U.S. PATENT DOCUMENTS

| | | | |
|---|---|---|---|
| 3,321,733 | 5/1967 | Thomas | 439/271 |
| 3,571,779 | 3/1971 | Collier | 439/271 |
| 3,721,948 | 3/1973 | Brandt et al. . | |
| 3,842,387 | 10/1974 | Santangelo | 434/271 |
| 4,059,325 | 11/1977 | Diminnie et al. . | |
| 4,109,989 | 8/1978 | Snyder, Jr. et al. | 439/271 |
| 4,796,159 | 1/1989 | Miksche | 361/429 |
| 4,824,390 | 4/1989 | Crane et al. | 439/271 |
| 4,889,497 | 12/1989 | Riches | 439/76 |
| 4,966,559 | 10/1990 | Wisner | 439/685 |
| 5,129,843 | 7/1992 | Bowsky | 439/685 |
| 5,131,858 | 7/1992 | Heimbrock | 439/685 |
| 5,199,893 | 4/1993 | Fussell | 439/271 |

*Primary Examiner*—Hien D. Vu

*Attorney, Agent, or Firm*—Polster, Lieder, Woodruff & Lucchei

[57] ABSTRACT

An electrical conductor pin assembly including at least one conductor pin having pin insulation, the conductor pin extending in sealed relation through a housing wall terminal assembly of a chamber and a lead wire connector block having an over-surface wall shield assembly extending from the outer face of the connector block configured to spacedly surround both the exposed pin assembly and pin insulation to provide tortuous passageways therebetween, the conductor pin of the assembly force fitting with a passageway in the connector block through a thin breakaway membrane with the wall shield assembly being in sealed relation wit the terminal assembly.

16 Claims, 3 Drawing Sheets

SEALABLE SHAPED CONNECTOR BLOCK FOR A TERMINAL ASSEMBLY

BACKGROUND OF THE INVENTION

The present invention relates to connector block modifications for a terminal assembly, the modified connector block being of type like those connector blocks disclosed in U.S. Pat. Nos. 5,129,843, issued to Benjamin Bowsky et. al on Jul. 14, 1992 and U.S. Pat. No. 5,131,858, issued to Henry H. Heimbrock on Jul. 21, 1992—the present invention including connector block modifications which serve to minimize contaminant leakage in ambient surroundings and to minimize undesirable arcing which, if combined with leakage contaminants, could lead to undesirable consequences.

In addition to the abovenoted two patents, both of which patents disclose over-surface wall shield members in surrounding relation to conductor pin end portions in order to minimize arcing, attention further is directed to: U.S. Pat. No. 3,721,948, issued to George W. Brandt et al on Mar. 2, 1972, which teaches several surrounding individual pin insulating sleeves all of which are surrounded as a group by a tubular member, the individual sleeves and tubular member extending from the inner face of a terminal cup in spaced relation from the peripheral side wall thereof; U.S. Pat. No. 4,059,325, issued to Edward A. Diminnie et al, which teaches a flat shield facing the peripheral edge of a terminal cup side wall; and to U.S. Pat. No. 4,966,559, issued to Ronald R. Wisner on Oct. 30, 1990, which teaches a pin surrounding cylindrical side wall portion extending from a connector block face to fit snugly in interface contact within the open end of the terminal body member side wall.

From the above, it can be seen that various attempts have been made in providing structure which shields conductor pins, as well as their insulating materials, from contaminants and to minimize undesirable conductive arcing paths. For the most part, these past structures have been comparatively complex and costly in both manufacture and assembly, have presented assembly, disassembly and wear problems and have fallen short of the results they have sought to achieve.

The present invention, recognizing the limitations of past structures, provides a unique connector block and terminal cup assembly which is straightforward and economical to manufacture, assemble and disassemble involving a minimum of parts and a minimum of steps. Further, the inventive structure provides for tortuous passages between over-surface shields and protected pins to minimize undesirable arcing and provides for a unique sealing arrangement to allow for ready assembly and disassembly and to minimize contaminant leakage,—thus minimizing the undesirable hazards which can arise from undesirable contaminant leakage and an accompanying undesirable arcing. In accordance with the present invention unique, yet inexpensive, sealing arrangements are provided between engaging parts without past problems of interengaging during assembly and freezing during disassembly. In addition, the present invention assures contaminant preventive sealing around each individual pin, around each of the protecting shield edges and along an over-all pin shield when it is moved into engagement with a terminal cup.

Various other features of the present invention will become obvious to one skilled in the art upon reading the disclosure set forth hereinafter.

BRIEF SUMMARY OF THE INVENTION

More particularly, the present invention provides in combination with a electrical conductor pin means including at least one conductor pin extending through a housing wall of a chamber to provide inner and outer pin end portions relative to the chamber with at least one of the pin end portions having surrounding insulative protection means extending along a part of the pin end portion adjacent the wall through which it extends with a remaining extremity of the pin end portion being free of insulation, an electrical connection to the conducting pin means comprising: a connector block to provide quick positive electrical connection to the at least one of the pin end portions of the conductor pin means, the connector block including first and second passageway means, the first passageway means serving to accommodate one end of lead wire means to be electrically connected to the at least one of the pin end portions of the conductor pin means and the second passageway means serving to accommodate passage of the remaining extremity of the one pin end portion therethrough; lead wire end means disposed in the first passageway means including clip means fastened to one of the extremities of the lead wire end means to be positioned adjacent the second passageway means to hold the lead wire end means firmly in position adjacent the second passageway means, the clip means being sized and configured to engage in electrically contacting relation with the remaining extremity of the one end portion of the conductor pin extending through the second passageway means; and, over-surface wall shield means fixed to and extending from the outer face of the connector block, the wall shield means being positioned and configured to extend in radially spaced surrounding relation adjacent and surrounding the entirety of the at least one end portion part of the conductor pin including that portion of the pin adjacent the wall having surrounding insulative protection means and the remaining extremity of the pin free of insulation and outside the connector block after the remaining extremity of the conductor pin extends through the second passageway to engage with the clip means so as to provide a surrounding tortuous over-surface passageway along the insulated and free end portion of said pin to minimize possible undesirable arcing of said pin. In addition, the present invention provides a unique sealing arrangement between the connector block and the walls of the terminal pin assembly, between the connector block over-all wallshield and individual wall shield means and a wall of the terminal assembly and between the individual pins and the connector block passageways through which the individual pins extend.

It is to be understood that various changes can be made in one or more of the several parts of the unique structure disclosed herein without departing from the scope or spirit of the present invention. For example, it would be possible to relocate sealing means along the edge of the over-all wall shield means rather than along the peripheral wall thereof so that sealing means engages with the flat inner bottom wall of the terminal cup through which the conductor pins extend.

BRIEF DESCRIPTION OF THE DRAWINGS

Referring to the drawings which disclose an advantageous embodiment of the present invention and a modification thereto.

DETAILED DESCRIPTION OF THE DRAWINGS

Figure 1:
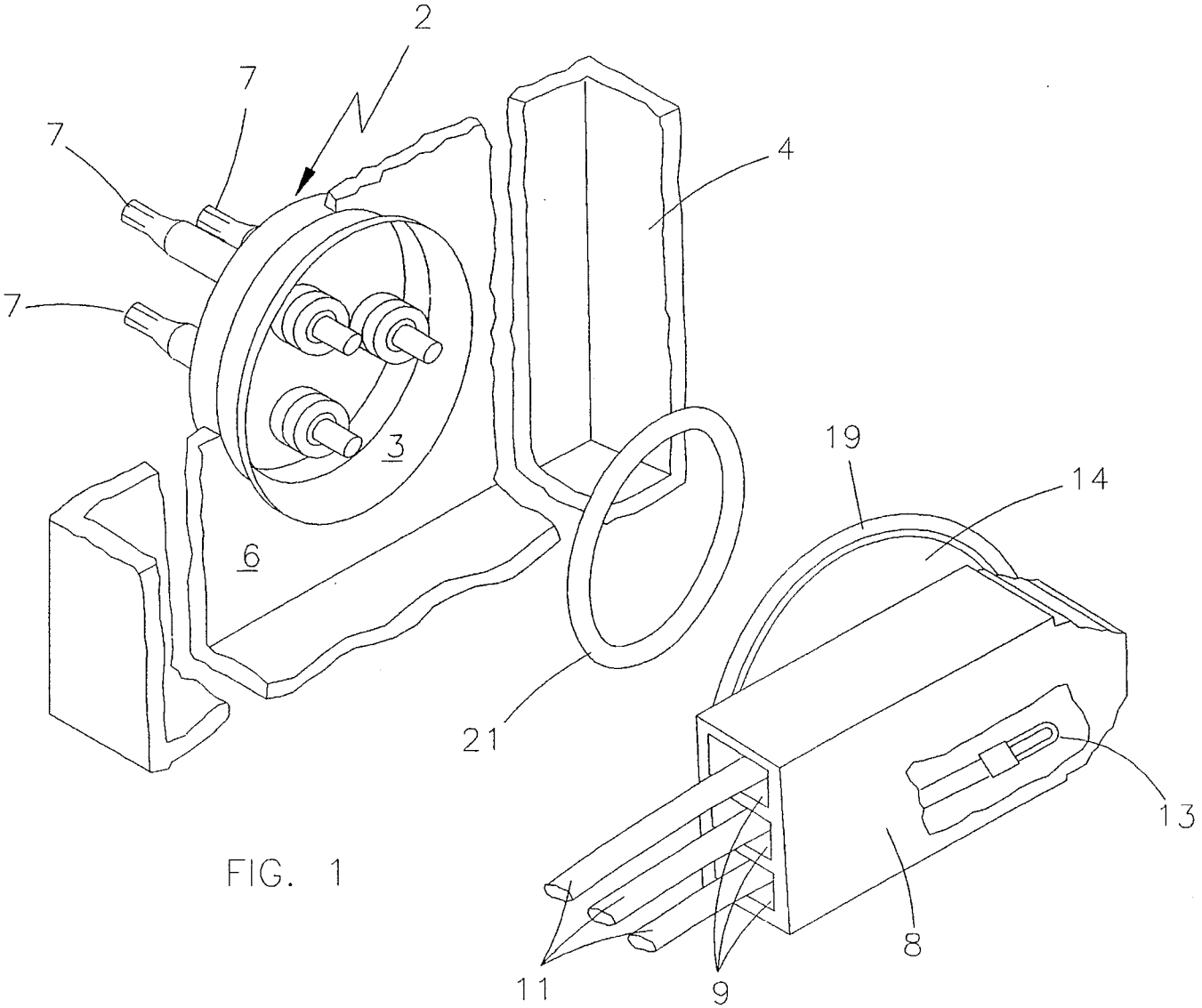
FIG. 1 is an expanded, partially broken away isometric view of the present invention disclosing the inner end portions of a hermetic terminal assembly projecting through the partially disclosed, broken away wall of a hermetically sealed chamber in combination with the novel, improved connector block for the pin end portions, including the sealing member to be engaged in a recess in the peripheral wall of the larger, surrounding over-surface wall shield member.

Referring to the isometric view of FIG. 1 of the drawing, an electrical conductor pin structure in the form of a terminal assembly 2 of a type known in the art can be seen assembled with its cup-shaped body 3 extending through and sealed along the peripheral rim thereof to an aperture in the wall 4 of a hermetically sealed compressor chamber 6. Extending in sealed relation through the base of cup-shaped body 3 are three spaced electrical conductor pins 7 to provide three spaced conductor pin end portions which extend into the low pressure (suction) side of the hermetically sealed compressor chamber 6. The structure described so far is like the structure of aforementioned U.S. Pat. No. 5,129,843, and is typical in the compressor art and thereof specific details of the terminal assembly are omitted. It only is essential to note that the inner pin end portions of pins 7 are on the low pressure side of wall 4 where conductor pin arcing is more likely to occur and the improved electrical connection finds more utility. However, it is to be understood that the novel electrical connection can be efficiently and effectively used in other pin environments and, in fact, it could be desirable to even use such a pin connection on the outer pin end portions of a terminal assembly. It further is to be understood that the present invention is not to be considered as limited for use only with three spaced pin assemblies, but can be adapted for use with one, two or other spaced plural pin clusters with the inventive connector block described hereinafter being appropriately modified to accommodate the number of spaced pins in the terminal assembly with which it is to be associated.

Figure 2:
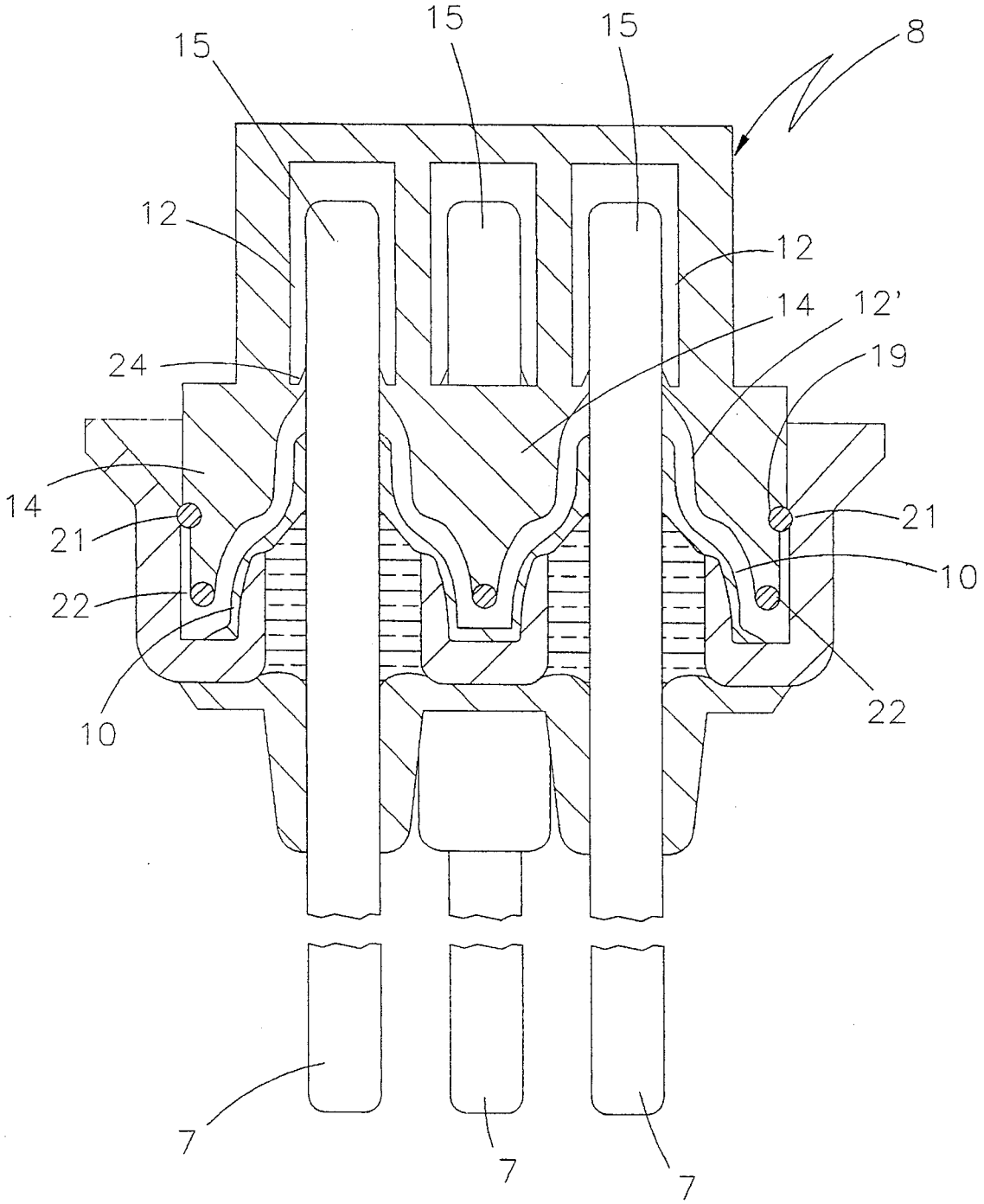
FIG. 2 is an enlarged, cross-sectional schematic view of the improved connector block of FIG. 1 schematically positioned about to fully engage with a hermetic terminal assembly, this Figure more fully disclosing the sealing members and the over-surface wall shields formed as a unitary part of the connector block.
Figure 4:
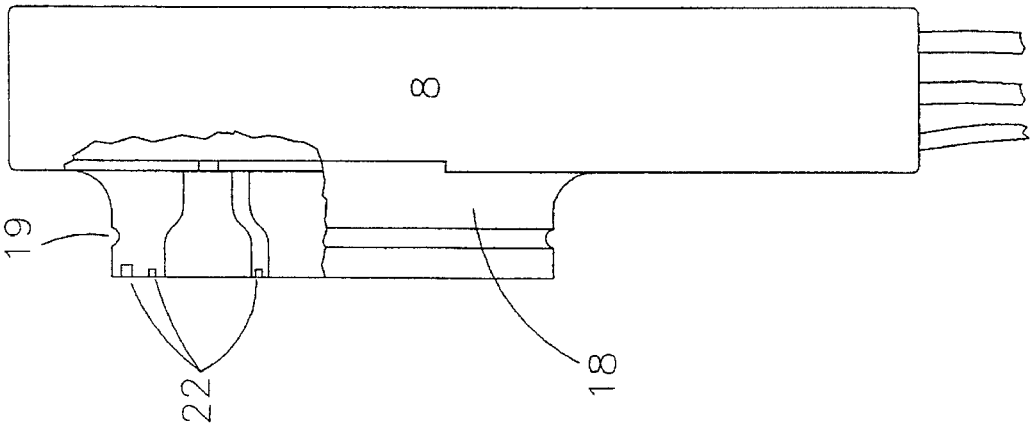
FIGS. 3 and 4 are enlarged from and side views of a modified unitary connector block capable of functioning in the same manner as the unitary connector block of FIGS. 1 and 2, these Figures disclosing three spaced wall shield members, one for each pin, and a surrounding, outer peripheral wall shield member adapted to sealingly engage with the inner side wall of the hermetic terminal assembly.
Figure 3:
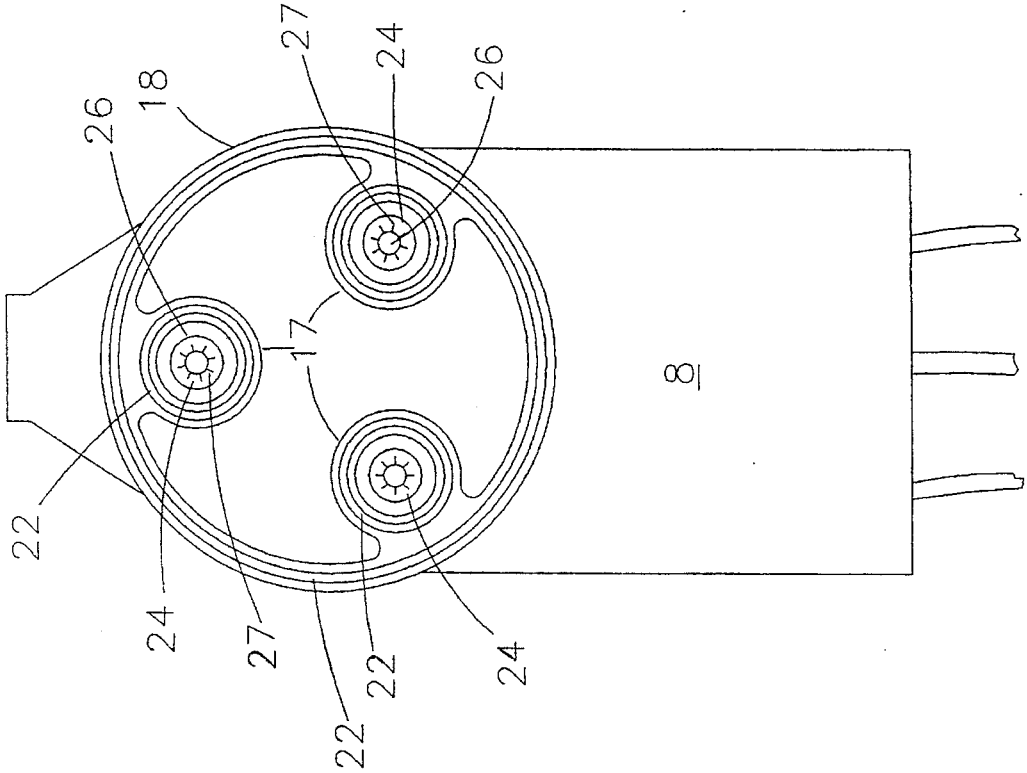

Still referring to FIG. 1 of the drawing and also to FIGS. 2–4, an improved unitary plastic connector block and modification incorporating the novel features of the present invention can be seen. Connector block 8 can be mold formed from any one of a number of known plastic compounds, advantageously with hard, insulative physical properties. To cooperatively engage with the inner ends of the three pins 7 of hermetic terminal assembly 2, connector block 8, like U.S. Pat. No. 5,129,843, includes three longitudinally extending separately spaced first passageways 9 as shown in FIG. 1, each being defined by peripheral side walls of rectangular cross-section and having lead wire end openings at one extremity thereof. These first passageways 9 serve to accommodate three lead wire ends 11 of lead wires which can be appropriately and electrically connected to a motor or other unit (not shown) which can be disposed in the hermetically sealed chamber defined by walls 4. The peripheral side wall defined first passageways 9 are each communicatively connected to one of three spaced openings or second passageways 12 (FIG. 2) which are appropriately spaced at the other end of plastic block 8 to receive therethrough the inner end portions of pins 7 of hermetic terminal assembly 2. End portions of pins 7, each include a surrounding insulative protection coating or jacket 10, which can be of a suitable plastic compound, and a remaining insulation free extremity 15. Spaced passageways 12 advantageously are of selected shape in cross-section to allow for clip positioning and locking. Each of lead wire ends 11 has a looped pin receiving clip 13 (FIG. 1) electrically fastened to its extremity to yieldingly receive one of the remaining insulation-free extremities of inner end portions of pins 7 passing through communicating passageway 12. Clips 13 fastened to lead wire ends 11 can be selected from any one of a number of electrically contacting type clips known in the electrical art and advantageously each clip 13 includes a detent arrangement to hold the clip and the lead wire end to which it is connected in a fast preselected position in the second passageway 12 with which passageway 11 communicates so as to electrically engage in yielding contact with the remaining insulation-free extremity 15 of inner end portion of a pin 7 extending through passageway 12 when connector block is assembled to terminal assembly 2.

As can be seen in FIGS. 1 and 2 of drawings and in accordance with one advantageous embodiment of the present invention, the improved, novel, connector plastic block 8 includes as a unitary part thereof three geometrically contoured and configured spaced over-surface open-ended cylindrical wall shields 14, each integrally molded as a unitary, integral part of plastic connector block 8. Each cylindrical wall shield 14 is positioned adjacent to and conformedly surrounds one of the key shaped second passageways 12 so as to extend coextensively and in spaced tortuous passageway 12' forming conformity with that part of the inner pin end portion of conductor pin 7, including insulating coating or jacket 10 and the insulation-free remaining extremity 15, minimizing possible through-space arcing of each of the spaced inner pin end portions with the other remaining pin end portions or other surfaces when the end portions are in yielding engagement with looped clips 13. It is to be understood that the shape and number of wall shields can be varied in accordance with the terminal assembly pins with which they are to be associated and that, although advantageously disclosed in FIGS. 1 and 2 as being an integrally molded unitary part of otherwise solid connector block 8, can be differently molded as in FIGS. 3 and 4 in the drawings or separately assembled and joined to the block as the occasion might require.

Referring to FIGS. 3 and 4 of the drawings another embodiment of the present invention is disclosed. In this embodiment of the invention, three separate and spaced-apart over-surface wall shields 17 are provided, the three wall shields 17 being surrounded in turn, by an overall encircling wall shield 18. It is to be understood that surrounding or encircling wall shield 18, as well as the three separate wall shields 17 disposed therein, can be molded as an integral part of unitary plastic connector block 8 or can be molded separately and then suitably fastened by an appropriate adhesive or fusion to connector block 8. In this regard, it is to be noted that the inventive embodiment of FIGS. 3 and 4 is lighter and uses less material than the integral wall shields 14 of FIGS. 1 and 2. It also is to be noted, in accordance with another feature of the present invention, that in each of the two embodiments disclosed that the outer peripheral face of wall shield 14 and the outer peripheral face of surrounding, encircling wall 18 are both sized to telescope within and be slightly spaced from the inner, peripheral side wall, or face of the cup shaped body 3 of terminal assembly 2. Further, the peripheral faces, advantageously in wall shields 14 and 18 are each providing with an encircling recess 19 to receive an appropriately sized, resilient, O-ring sealing member, advantageously formed from a suitable, chemically resistive, elastomeric material. O-ring 21, in each instance, is sized in thickness relative the spacing of the telescoping walls to serve as a sealing member cooperative between the slightly spaced outer peripheral surface of the wall shield and the inner peripheral side wall face of cup shaped body 3 to minimize possible passage of undesirable gas from the chamber housing 6 through wall 4 of such chamber into connector block 8.

Figure 5:
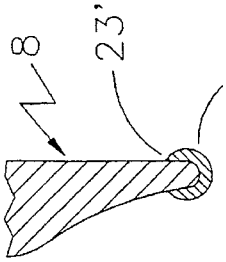
FIG. 5 is an enlarged cross-sectional view of a portion of an O-ring split along periphery thereof to provide a longitudinally extending slit of U-shaped cross-section to engage in lapping relation with opposed faces adjacent the partially disclosed distal wall shield edge; and, FIG. 6 is an enlarged partial view of a modified pin passage and press-fit pin arrangement.

Referring to FIGS. 2, 3 and 4, in order to further minimize gas leakages, additional O-ring seals 22 can be provided in appropriate recesses along thickened distal edges of the outer most surrounding walls shield and in appropriate recesses along thickened edges of smaller wall shields 14 and 17. Further, instead of utilizing O-ring seals 22, seals 23, each slit along the periphery to provide a longitudinally extending slit 23' of U-shaped cross-section, can be provided (FIG. 5), the slit 23' serving to allow ring 23 to engage in lapping relation with the edges of the opposed faces adjacent the wall shield distal edge without necessitating the use of recesses to receive O-ring seals such as 22.

Figure 6:
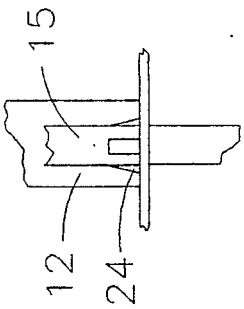

As a further feature of the present invention, and referring to FIG. 6 of the drawings, each passageway 12 can be sized in cross-section relative its electrical pin extremity 15 so as to be minimally smaller to thus require a press-fit engagement which further serves to minimize any possible leakage into connector block 8. Further, and as can be seen in FIGS. 1 and 3, plastic connector block 8 can be so provided to include, as an integral, continuous part thereof, a thin molded breakaway membrane 24 covering each passageway 12 to prevent leakage around pin 7 inserted therein. Advantageously, each membrane 24 can include a central aperture 26 disposed therein with each aperture 26 being of smaller cross-sectional area passageway and the cross-sectional area of pin 7 which it receives and with each aperture 26 further including radially spaced breakaway weakness lines 27 extending radially from the periphery thereof and being resibently and flexible yieldable as shown in FIG. 6, to the pressure fit of the end portion of pin 7 free of insulation.

From the above, it can be seen that a unique structural arrangement is provided which in a straightforward and economical manner serves to both minimize undesirable arcing and undesirable gas leakage.

The invention claimed is:

1. An electrical connector block having a plurality of spaced electrical conductor pin portions extending through a sealed chamber housing wall of a hematic terminal assembly each of said pin portions having surrounding pin insulation protection adjacent said housing wall with the remainder of said pin portions being free of insulation to engage with a connector block electrical clip positioned in one of each of a plurality of passages in said connector block comprising: a one piece wall shield sized to surround the entirety of said spaced conductor pin portions with a distal free edge of said wall shield positionable directly in contact with said chamber housing wall, said one piece wall shield including a plurality of individual, spaced, tortuous wall shield passages integrally formed with said one piece wall shield, each of said passages having a cup shape and extending inwardly from said distal free edge of said one piece wall shield to communicably with said connector block electrical clip disposed in one of said corresponding passages in said connector block, each of said tortuous wall shield passages being so contoured that when said pin portion free of insulation engages with said connector block electrical clip, said tortuous passageways are in radially spaced surrounding and engaging with said pin portions including said surrounding pin insulation protections and any of said pin portion free of insulation so as to minimize possible electrical arcing.

2. The connector block of claim 1, wherein said one piece wall shield structure being an integral plastic portion of said connector block.

3. The connector block of claim 1, said plurality of spaced tortuous passages each having means requiring a pressure fit therethrough of said remainder of said pin portion free of insulation.

4. The connector block of claim 3, wherein said means requiring a pressure fit therethrough includes a thin, breakaway membrane yieldable to said pressure fit of said end portion of said pin portion free of insulation.

5. The connector block of claim 4, wherein said thin, breakaway membrane includes radially spaced breakaway weakness lines extending inwardly substantially from the periphery of said thin, breakaway membrane.

6. The connector block of claim 4, wherein said thin breakaway membrane includes a central aperture therein of smaller cross-sectional area than said passageway to enhance pressure-fit passage of said end portion of said pin free of insulation.

7. The connector block of claim 6, wherein said central aperture includes radial spaced breakaway weakness lines extending from the periphery of said central aperture toward the peripheral wall of said passageway.

8. The connector block of claim 1, said spaced conductor pin portions passing in insulated sealed relation through a bottom wall of a terminal cup of said hermatic terminal assembly having inner and outer peripheral surfaces with said inner peripheral surface including an inner bottom wall surface and said outer peripheral surface of said terminal cup being hermetically sealed in said chamber housing wall of said one piece wall shield, said one piece wall shield having resilient sealing means cooperative between said outer peripheral surface of said one piece wall shield and said inner peripheral surface of said terminal cup when said terminal cup and said one piece wall shield of said connector block are connectively assembled to minimize possible passage of gas from said chamber housing to said connector block.

9. The connector block of claim 8, said sealing means including a ring-like sealing membrane cooperative between said outer peripheral surface of said one piece wall shield and the inner peripheral surface of said terminal cup when said terminal cup and said one piece wall shield of said connector block are connectively assembled.

10. The connector block of claim 8, said sealing means including a sealing membrane cooperative between said distal free edge of said one piece wall shield and the inner bottom wall surface of said terminal cup when said terminal cup and said one piece wall shield of said connector block are connectively assembled.

11. The connector block of claim 8, said resilient sealing means including a first sealing membrane cooperative between the outer peripheral surface of said one piece wall shield and the inner surface of said terminal cup and a second sealing membrane cooperative between the free distal edge of said one piece wall shield and the inner surface of said terminal cup when said terminal cup and said one piece wall shield of said connector block are connectively assembled.

12. The connector block of claim 11, said outer surface of said one piece wall shield and said distal free edge of said one piece wall shield having recesses to accommodate said sealing means in the form of appropriately sized resilient O-rings.

13. The connector block of claim 8, said one piece wall shield including recess means in said outer surface thereof, said sealing means being of appropriately sized, resilient O-ring shape to cooperate with said recess means.

14. The connector block of claim 8, said sealing means being of appropriately sized, resilient O-ring shape with a longitudinally extending slit therein of U-shaped cross-section extending therearound to engage in lapping relation with opposed faces adjacent said free edge of said one piece wall shield.

15. The connector wall shield structure of claim 8, each of said individual, spaced, tortuous passages having a resilient sealing membrane cooperative between the distal free edge of said passage and said inner bottom wall surface of said terminal cup.

16. A plastic connector block wall shield structure integrally formed with a plastic electrical connector block to receive three spaced electrical conductor pin portions extending through a bottom wall of a terminal cup of a hematic terminal assembly including a surrounding side wall extending therefrom, each bottom and side wall of said terminal cup including inner and outer peripheral surfaces, said outer peripheral surface of said surrounding side wall of said terminal cup being hermetically sealed in an hermetically sealed chamber housing wall, said three spaced electrical conductor pin portions extending through said bottom wall surface of said terminal cup, each pin portion including a surrounding pin insulating protection adjacent said inner bottom wall of said terminal cup with the remainder being free of insulation to engage with a connector block electrical clip positioned in one of each of three passages in said connector block, said plastic connector wall shield structure comprising: a one piece wall shield sized to surround said three spaced conductor pin portions with distal free edge of said overall wall shield having a resilient O-ring connected thereto positionable immediately adjacent said inner peripheral surface of said bottom wall of said terminal cup, said one piece wall shield further including a resilient O-ring disposed in a recess in said outer peripheral wall of said one piece wall shield to sealingly abut against said inner peripheral surfaces of said side wall of said terminal cup, said one piece wall shield including three individual, spaced tortuous passages integrally formed with said one piece wall shield each of said passages communicably to one of said electrical clips disposed in a passage of said connector block, each of said tortuous passages in said one piece wall shield having a cup shape extending inwardly from said distal free edge of said one piece wall shield and having an individual resilient seal disposed at said distal free edge of said passage to abut in sealing relation with said inner surface of said bottom wall of said terminal cup, each tortuous passage further having a thin, yieldable breakaway membrane extending thereacross to require a pressure fit with said remainder of said pin portion free of insulation when passed therethrough, each breakaway membrane including a central aperture with radially spaced breakaway weakness lines extending from periphery of said central aperture toward the peripheral wall of said passageway.

* * * * *